US011608658B1

(12) United States Patent
Derman

(10) Patent No.: US 11,608,658 B1
(45) Date of Patent: Mar. 21, 2023

(54) PADLOCK SECURITY 3

(71) Applicant: Jay S. Derman, Carlsbad, CA (US)

(72) Inventor: Jay S. Derman, Carlsbad, CA (US)

( * ) Notice: Subject to any disclaimer, the term of this patent is extended or adjusted under 35 U.S.C. 154(b) by 0 days.

(21) Appl. No.: 17/735,104

(22) Filed: May 2, 2022

Related U.S. Application Data

(63) Continuation-in-part of application No. 17/246,506, filed on Apr. 30, 2021, now Pat. No. 11,319,730, which is a continuation-in-part of application No. 16/658,014, filed on Oct. 18, 2019, now Pat. No. 10,995,522.

(60) Provisional application No. 62/873,229, filed on Jul. 12, 2019.

(51) Int. Cl.
*E05B 67/38* (2006.01)
*E05B 17/20* (2006.01)

(52) U.S. Cl.
CPC ..... *E05B 67/38* (2013.01); *E05B 17/2084* (2013.01); *E05B 2067/386* (2013.01)

(58) Field of Classification Search
CPC ..... E05B 67/38; E05B 2067/386; E05B 17/2084; Y10T 70/493; Y10T 70/496; Y10T 70/498; Y10T 70/7915; Y10T 70/7932; Y10T 70/7955; Y10T 70/796; Y10T 70/7977; Y10T 70/7983
USPC ..... 70/54–56, 416, 419, 423, 424, 427, 428
See application file for complete search history.

(56) References Cited

U.S. PATENT DOCUMENTS 3,559,429 A * 2/1971 Hermann ..... E05B 67/38 70/56
3,751,948 A * 8/1973 Klein ..... E05B 67/38 70/417
4,112,716 A * 9/1978 Wippich ..... E05B 67/003 70/52
4,286,445 A * 9/1981 Sills ..... E05B 17/002 70/455
4,576,022 A * 3/1986 Gamble ..... E05B 19/0005 70/55
4,686,840 A * 8/1987 McCarroll ..... E05B 17/14 70/455
4,760,720 A * 8/1988 Grille ..... E05B 67/38 70/56
4,781,043 A * 11/1988 Loeffler ..... E05B 67/38 70/417
4,905,486 A * 3/1990 Appelbaum ..... E05B 67/38 70/417

(Continued)

*Primary Examiner* — Suzanne L Barrett

(57) ABSTRACT

An enclosure for improving padlock security is provided. The enclosure includes a sleeve component that has openings at the left and right for receiving the padlock, cutouts at the top to access the shackle holes and a key slot at the bottom for accessing the padlock. A means for supporting the padlock within the sleeve component creates an empty space between the bottom of the padlock and the bottom of the sleeve component. The sleeve component containing the padlock is inserted into a tubular component. The tubular component has walls forming the tubular component, an opening at the bottom for receiving the sleeve component and padlock, one or more stoppers, capable of contacting the body of the padlock preventing further insertion of the padlock, while allowing the shackle to continue past, two directly opposing openings on the walls of the enclosure, and an opening at the top for accessing the shackle.

20 Claims, 22 Drawing Sheets

(56) References Cited

U.S. PATENT DOCUMENTS

| | | | | | |
|---|---|---|---|---|---|
| 5,146,771 | A * | 9/1992 | Loughlin | E05B 67/38 | 70/56 |
| 5,477,710 | A * | 12/1995 | Stefanutti | E05B 67/38 | 70/56 |
| 5,704,231 | A * | 1/1998 | Heald | E05B 17/002 | 70/424 |
| 5,743,118 | A * | 4/1998 | Anderson | E05B 13/002 | 292/205 |
| 6,305,198 | B1 * | 10/2001 | Chastain | E05B 67/28 | 70/52 |
| 6,467,316 | B1 * | 10/2002 | Chen | E05B 67/02 | 70/423 |
| 6,684,668 | B1 * | 2/2004 | Hsueh Lee | E05B 67/02 | 70/52 |
| 7,581,423 | B2 * | 9/2009 | Brojanac | E05B 17/002 | 70/52 |
| D711,724 | S * | 8/2014 | Newchurch | D8/346 | |
| 8,820,128 | B2 * | 9/2014 | Liu | E05B 17/142 | 70/423 |
| 10,995,522 | B2 * | 5/2021 | Derman | E05B 67/38 | |
| 11,319,730 | B1 * | 5/2022 | Derman | E05B 67/38 | |
| 2005/0155396 | A1 * | 7/2005 | Taljaard | E05B 67/38 | 70/56 |
| 2006/0162402 | A1 * | 7/2006 | Elliot | E05B 67/02 | 70/56 |
| 2012/0180535 | A1 * | 7/2012 | Dorste | E05B 67/38 | 70/56 |

* cited by examiner

3500

3600

3700

3800

3900

4000

4100

PADLOCK SECURITY 3

CROSS REFERENCE TO RELATED APPLICATIONS

This application is a continuation in part that claims priority from non provisional U.S. patent application Ser. No. 17/246,506 filed on Apr. 30, 2021. Ser. No. 17/246,506 is a continuation in part US patent application that claims priority from a non provisional application Ser. No. 16/658,014 filed on Aug. 18, 2019. Ser. No. 16/658,014 is a non provisional US patent application that claims priority from a provisional application 62/873,229 filed on Jul. 12, 2019.

FIELD OF THE INVENTION

Embodiments of the invention generally relate to padlocks. Specifically, embodiments of the invention relate to an enclosure that protects and limits access to the top and bottom of a padlock.

BACKGROUND OF THE INVENTION

A conventional padlock consists of a lock body, a shackle (commonly U shaped) operatively locked in or unlocked from the lock body, and a key-operated locking device formed in the lock body for operatively unlocking the shackle from the padlock by using a key. A padlock, if provided with a key-operated locking mechanism therein, should be unlocked only by a key.

Lock picking is the practice of unlocking a lock by manipulating the components of the lock device without the key. This is generally done by accessing the keyhole with various lock picking tools, such as torque and tension tools or a rake, but can also include bobby pins, safety pins, and paperclips. In the modern era, with so much information available to the public, more and more individuals are learning how to pick a lock with new and improved methods. The Lock Picking Lawyer, an internet personality, regularly shows the ease at which locks can be picked and that virtually no lock is pick proof. Other online resources provide information on how to pick locks with tools as common as bobby pins and paperclips. This essentially turns a padlock into an overpriced paperweight.

The purpose of a lock is to prevent unauthorized persons from gaining access to any area which has been closed and locked. Locks range from securing the side gate of a person's yard to something as serious as the trigger lock on a person's gun from access by an intruder or a child. A parent or guardian may want to prevent a child or teenager from accessing items like a lock include a laptop, legal drugs, money. However, a child or teenager is now very capable of picking a lock. Additionally, many insurance companies will deny claims for stolen property when locks are picked as there is no sign of forced entry. Since lock picking runs afoul of the intended purpose of a padlock, there is a need for new methods to thwart lock picking and tampering.

SUMMARY

The purpose of a lock is to prevent unauthorized persons from gaining access to any area which has been closed and locked. However, more and more individuals are learning how to pick a lock with new and improved methods. Various online resources provide information on how to pick locks with tools as common as bobby pins and paperclips. The primary purpose and benefit of the disclosed invention is to improve the security provided by a padlock by limiting access to the padlock, most specifically the keyhole, thereby making lock picking and tampering more difficult or impossible. The disclosed invention makes a padlock more secure which can have wide ranging benefits in protecting personal property and deterring entry.

An enclosure for protect a padlock having a body, a shackle and a keyhole is provided. The enclosure includes a sleeve component that has openings at the left and right for receiving the padlock, cutouts at the top to access the shackle holes and a key slot at the bottom for accessing the padlock. A means for supporting the padlock within the sleeve component creates an empty space between the bottom of the padlock and the bottom of the sleeve component. The sleeve component containing the padlock is inserted into a tubular component. The tubular component has walls forming the tubular component, an opening at the bottom for receiving the sleeve component and padlock, one or more stoppers, capable of contacting the body of the padlock preventing further insertion of the padlock, while allowing the shackle to continue past, two directly opposing openings on the walls of the enclosure, and an opening at the top for accessing the shackle.

The sleeve component can additionally have a securement mechanism at the top to prevent the padlock from falling through the opening at the bottom of the tubular component. The sleeve component can additionally have a magnet internally affixed in place to the bottom of the enclosure adjacent to the key slot capable of adhering to metallic objects inserted through the key slot. The heights of the tubular and sleeve component can be made such that the distance between bottom of the padlock and bottom of the enclosure creates a storage compartment within the enclosure below the padlock. A hole in the sleeve component can receive an eyebolt fixed to the padlock shackle A plate component having a top plate the shape and size of the opening at the top of the tubular component and shackle legs extending from the bottom of the top plate can be used to secure the padlock in place of the padlock shackles. The use of a rod extending from the top of the sleeve component or the bottom of the plate component can be used to secure a cable or a chain

BRIEF DESCRIPTION OF THE DRAWINGS

The accompanying drawings taken in conjunction with the detailed description will assist in making the advantages and aspects of the disclosure more apparent.

DETAILED DESCRIPTION

Figure 1:
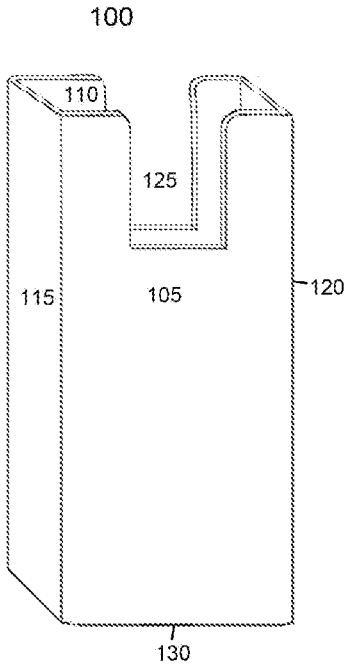
FIG. 1 is a perspective view of an outer tube component of an enclosure embodiment.

Reference will now be made in detail to the present embodiments discussed herein, illustrated in the accompanying drawings. The embodiments are described below to explain the disclosed invention by referring to the Figures using like numerals. It will nevertheless be understood that no limitation of the scope is thereby intended, such alterations and further modifications in the illustrated invention, and such further applications of the principles as illustrated therein being contemplated as would normally occur to one skilled in the art to which the embodiments relate.

A padlock security enclosure, that protects and limits access to a padlock to secure a chain or cable, is provided. The enclosure comprises one or more components, though each component may be used separately. The first component is an outer tube having an open bottom, such that a padlock can be inserted into the enclosure. The padlock is inserted into the enclosure until it encounters one or more stoppers that come in contact with the body of the lock preventing any further insertion. When it is secured to an object, such as a chain or latch, the lock cannot fall through the bottom of the enclosure. A top plate can prevent access to the shackle and can have shackle legs that are inserted into the padlock to secure the padlock instead of the padlock shackle. The enclosure is taller than the padlock, such that when fully inserted, the enclosure extends beyond the bottom of the lock preventing and limiting access to the keyhole at the bottom of the lock. The second component is an inner sleeve having openings on the side whereby the lock body is inserted sideways into the sleeve. Alternatively, the second component can be an inner sleeve having openings on the front and back whereby the lock body is inserted into the sleeve through the front or back. This sleeve component of the enclosure covers the keyhole limiting access to the keyhole only by a key slot. In the preferred embodiment, the padlock is first inserted into the inner sleeve, which is then inserted into the outer tube. A center rod can hold the ends of a chain or lugged ends of cable in place, the rod attached to the top of the inner sleeve or bottom of the top plate. The components can be used separately or in combination to protect a padlock.

The primary purpose and benefit of the disclosed invention is to improve the security provided by a padlock. This is done by limiting access to the padlock, most specifically the keyhole, thereby making lock pick proof and tamper proof. The enclosure further improves the ability to secure a cable or chain using a padlock. Other benefits with the disclosed enclosure can include protecting the lock and shackle from physical damage by bludgeoning or cutting with bolt cutters. Locks vary in the tools and means required to successfully pick them, and the enclosure, by additionally hiding the make and model of the lock from view, makes it more difficult to determine how best to pick the lock. The disclosed invention makes a padlock more secure which can have wide ranging benefits from protecting personal property from theft to life saving benefits such as protecting a trigger lock on a handgun.

The disclosed invention is meant to protect a conventional padlock having a lock body, a shackle (commonly U shaped) operatively locked in or unlocked from the lock body, and a key-operated locking device formed in the lock body for operatively unlocking the shackle from the padlock by using a key. A shackle can be a stationary shackle that completely detaches from the lock body or a swinging shackle that detaches on one side and swings away from the lock body. Alternatively, in some disclosed embodiments, the enclosure's shackle legs are configured to be inserted into the lock body to secure the padlock in the enclosure. The keyhole is located at the bottom of the padlock and the enclosure is intended to limit access to the padlock, most specifically the keyhole, thereby making lock picking more difficult or impossible. The enclosure can be customized to work with a variety of locks and lock bodies, and this specification describes an enclosure that is sized and configured to work with the appropriate sized lock.

As illustrated in FIG. 1, a perspective view of an outer tube component 100 of a padlock enclosure embodiment is provided. The enclosure component can be made of a variety of materials, though a strong metal that is not easily cut, broken, or drilled into is preferred. The outer tube component has 4 sides described as front 105, back 110, left 115 and right 120, and openings described as top 125 and bottom 130. The padlock is inserted into the opening 130 at the bottom of the enclosure until it reaches a stopper that comes in contact with the body of the padlock and prevents further insertion.

Figure 2:
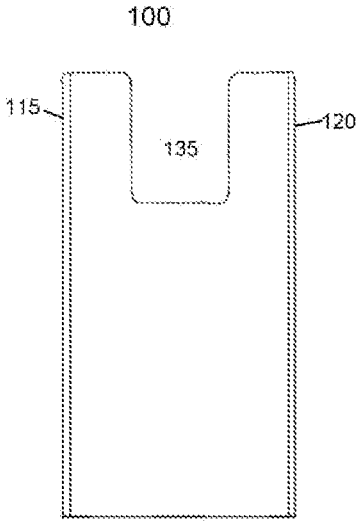
FIG. 2 is a front view of an outer tube component of an enclosure embodiment.

As depicted in FIG. 2, a view of the front of the first outer tube component 100 of the enclosure embodiment is provided. The enclosure component is rectangular shaped with a cut out section 135 on both the front and back allowing access to the shackle for the purpose of securing the lock. Such a cutout or opening appears on the front and back side of the enclosure, at or above the stoppers and proceeding upward to the top of opening. The sides 115, 120 of the enclosure prevent inappropriate access to the shackle, such as attempts to bludgeon or cut the shackle. Other embodiments can have rectangular openings on the front and back sides of the component or can have rectangular openings on the left and right sides of the component. The openings on the opposing sides allow the ends of a chain or lugged end of a cable to be secured by the padlock. The size of the openings can vary depending on the size of the chain or cable, so that a chain or cable can be inserted into the opening.

Figure 3:
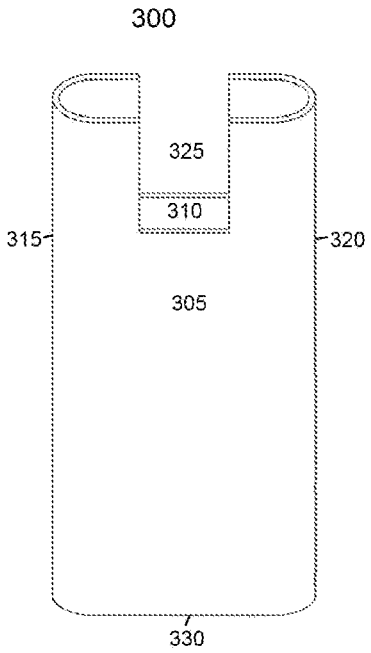
FIG. 3 is a perspective view of an alternative outer tube component of an enclosure embodiment.

As illustrated in FIG. 3, a perspective view of an outer tube component 300 of a padlock enclosure embodiment is provided. The enclosure component can be made of a variety of materials, though a strong metal that is not easily cut, broken, or drilled into is preferred. The outer tube component has 2 flat opposing sides described as front 305 and back 310, and 2 curved sides described as left 315 and right 320, and openings described as top 325 and bottom 330. The padlock is inserted into the opening 330 at the bottom of the enclosure until it reaches a stopper that comes in contact with the body of the padlock and prevents further insertion.

Figure 4:
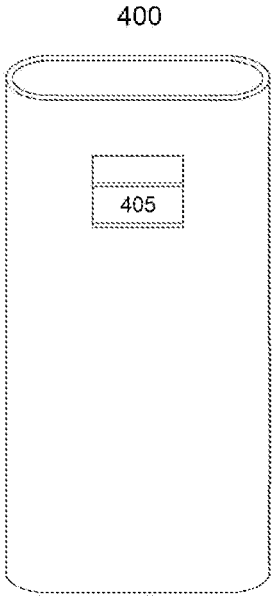
FIG. 4 is a perspective view of an alternative outer tube component of an enclosure embodiment.
Figure 5:
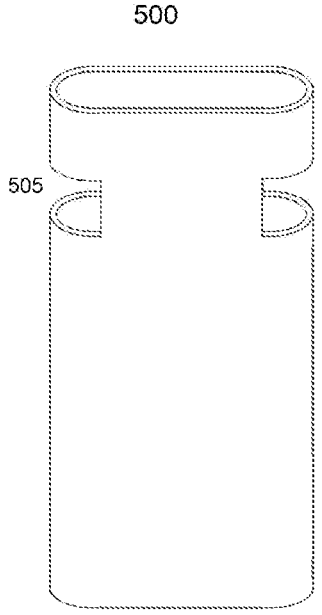
FIG. 5 is a perspective view of an alternative outer tube component of an enclosure embodiment.

FIGS. 4 and 5 depict perspective views of alternative embodiments 400, 500 having openings on the front and back sides 405 of the embodiments and having rectangular openings on the left and right sides 505 of the embodiment. The openings on the opposing sides allow the ends of a chain or lugged end of a cable to be secured by the padlock. The size of the openings can vary depending on the size of the chain or cable, so that a chain or cable can be inserted into the opening.

Figure 6:
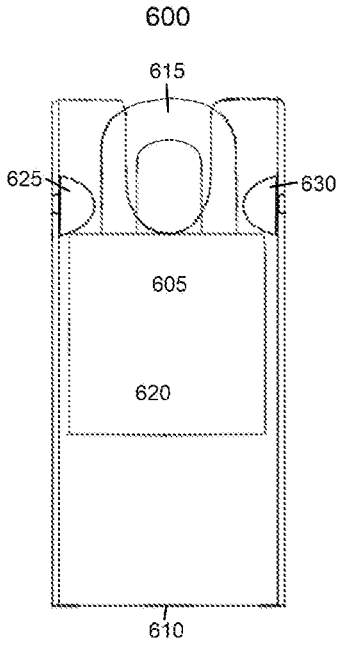
FIG. 6 is a vertical slice of the front of an outer tube component of an enclosure embodiment with padlock.

As illustrated in FIG. 6, a vertical slice of the front of an outer tube component 600 of the enclosure embodiment with padlock inserted, is provided in order to show the padlock inside of the enclosure. The padlock 605 is inserted into the enclosure through an opening 610 in the bottom of the enclosure, the shackle 615 inserted first, followed by the body 620 of the lock. The hole 610 in the bottom of the enclosure should be slightly larger than base of the body 620 of the padlock to allow for padlock to be inserted comfortably while not being able to rotate within the enclosure. The padlock is inserted until the lock body encounters one or more stoppers 625, 630 that prevent any further insertion. The narrower shackle 615 is able to continue past the stoppers 625, 630 where it is aligned and accessible for the purpose of latching to an object. In the depicted embodiment, the stoppers 625, 630 are 2 screws or bolts that have been attached to the interior walls of the enclosure. This invention contemplates other stoppers whereby the body of the padlock is stopped from any further insertion, such stoppers that include but are not limited to weldings on the inside of the enclosure, rivets driven into the enclosure from the outside, and dents, narrowings, or otherwise inward bent portions of the enclosure. The stopper must only prevent further insertion of the lock by contacting the lock body, while still allowing the shackle to continue past the stopper. Although, the depicted embodiment shows stoppers on the left and right interior walls of the enclosure, the stoppers can extend from any interior wall of the enclosure. Once latched, the padlock 605 will not be able to fall out the bottom of the enclosure. In some embodiments, a screw or similar securement mechanism can be inserted into the enclosure near the bottom in order to catch the padlock and prevent it from falling out the bottom of the enclosure, when it is unlocked.

The enclosure can vary in how tall it is, and the drawings in no way limit the size of the enclosure contemplated by this disclosure. The taller the enclosure is, the further the padlock is from the bottom of the enclosure, thus increasing the difficulty of accessing the lock. The key must be able to access the lock from the bottom of the enclosure through a length of tube. This length ultimately requires a key, made longer by extending the handle, or requires a tool, such as a wand or forceps that is able to grasp the key to access the keyhole of the padlock. While an owner of the enclosure and padlock would invariably carry, have access to, or have knowledge of the whereabouts of such a key (an owner knows when they intend to open a lock), it would be less likely that a lock picker would have lock picking tools of the necessary length.

Figure 7:
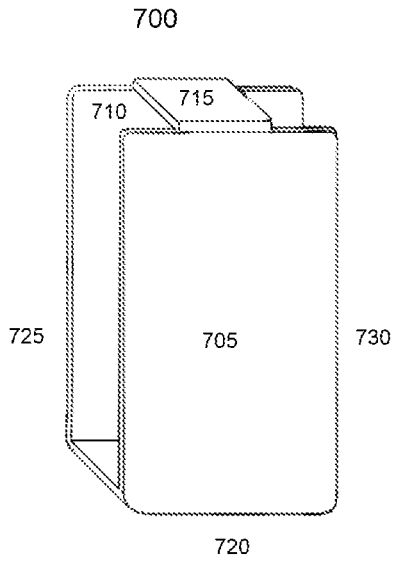
FIG. 7 is a perspective view of an inner sleeve component of an enclosure embodiment.

As illustrated in FIG. 7, a perspective view of an inner sleeve component 700 of a padlock enclosure embodiment is provided. The enclosure component can be made of a variety of materials, though a strong metal that is not easily cut, broken, or drilled into is preferred. The inner sleeve component has 4 sides described as front 705, back 710, top 715, and bottom 720, and openings described as left 725 and right 730. The padlock is inserted in to the opening at either the left of right opening of the enclosure. The top 715 of the sleeve has cutouts so that the top is small enough to fit between the shackle legs of a padlock. In alternative embodiments the top is a complete side with circular cutouts specifically configured to the size of the shackle legs of the padlock.

Figure 8:
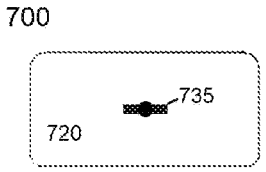
FIG. 8 is a bottom view of an inner sleeve component of an enclosure embodiment.
Figure 9:
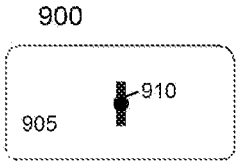
FIG. 9 is a bottom view of an alternative inner sleeve component of an enclosure
Figure 10:
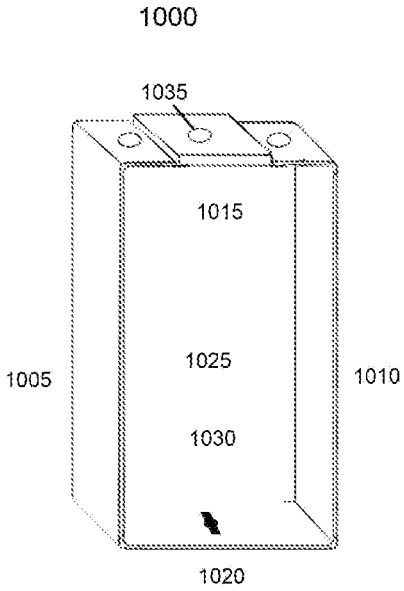
FIG. 10 is a perspective view of an alternative inner sleeve component of an enclosure embodiment.

As depicted in FIGS. 8 and 9, views of the bottom of the inner sleeve component 700, 900 of the enclosure embodiment is provided. The bottom side 705, 905 of the enclosure prevents access to the keyhole of the padlock, except by a key slot 710, 910. The drawings show alternative embodiments where the key slot 710, 910 can be configured to be horizontal or vertical. This can be done to match the keyhole on the padlock that the enclosure is protecting. In the preferred embodiment, the key slot is configured to be at a 90 degree rotational offset relative to the keyhole on the padlock. This offset requires a user to insert the key through the key slot, turn the key 90 degrees, and then insert the key into the keyhole of the padlock As illustrated in FIG. 10, a perspective view of an alternative inner sleeve component 1000 of a padlock enclosure embodiment is provided. The enclosure component can be made of a variety of materials, though a strong metal that is not easily cut, broken, or drilled into is preferred. The inner sleeve component has 4 sides described as left 1005, right 1010, top 1015, and bottom 920, and openings described as front 1025 and back 1030. The padlock is inserted into the opening at either the left of right opening of the enclosure. The top 1015 of the sleeve has circular cutouts specifically configured to the size of the shackle legs of the padlock. Some embodiments include a circular cutout 1035 on the top 1015 capable of receiving an eyebolt or other rod that is secure in place when the padlock is latched. Both the eyebolt or rod and the top 1015 must be of sufficient thickness and strength to with significant force. A similar circular cutout can be included in the embodiment depicted in FIG. 9 as well.

Figure 11:
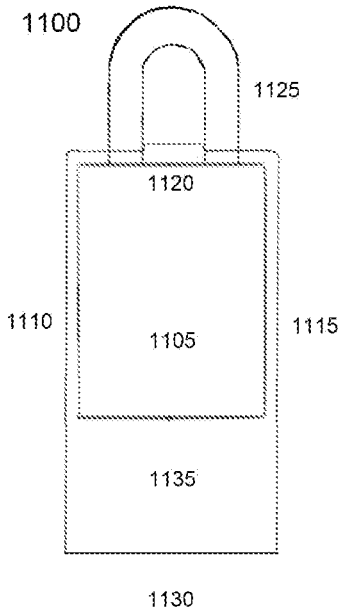
FIG. 11 is a vertical slice of the front of an inner sleeve component of an enclosure embodiment with padlock.

As depicted in FIG. 11, a vertical slice of the front of the inner sleeve component 1100 of an enclosure embodiment with padlock inserted, is provided in order to show the padlock inside of the enclosure. The padlock 1105 is inserted through an opening at either the left 1110 of right side 1115 of the enclosure as depicted in FIG. 7 or alternatively through an opening at either the front or back of the enclosure as depicted in FIG. 10. The padlock is positioned such that the top 1120 of the inner sleeve component fits between the padlock shackle legs 1125. This occurs naturally with a padlock having a swinging shackle, where the padlock is inserted into the inner sleeve component until the shackle contacts the top 1120 of the sleeve component. The lock is then secured in the enclosure when it is latched. The bottom 1130 of the enclosure protects the keyhole from access except by the key slot. Additionally, the bottom of the enclosure obscures any view of the padlock and padlock keyhole, forcing a person attempting to pick the padlock to do so blindly. In the preferred embodiment, the inner sleeve component is significantly taller than the padlock 1105, such that there is empty space 1135 between the bottom of the padlock and the bottom 1130 of the enclosure. The taller the enclosure is, the further the padlock is from the bottom of the enclosure, thus increasing the difficulty of accessing the lock. This distance ultimately requires a key that is able to pass through the key slot and continue to the keyhole of the padlock. While an owner of the enclosure and padlock would invariably carry such a key, it would be less likely that a lock picker would carry tools of the necessary length. This disclosure contemplates key slots of varying size and depth and keys of varying size and strength. Further, in this embodiment, the key slot can be configured to be at a 90 degree rotation relative to the keyhole on the padlock. This requires a person to insert the key through the key slot and then turn the key 90 degrees in order to unlock the padlock. This need to turn the key 90 degrees to access the keyhole of the padlock would not be visible to a person attempting to pick the lock.

Figure 12:
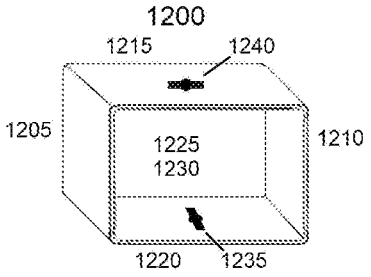
FIG. 12 is a perspective view of a rectangular tube component.

As illustrated in FIG. 12, a perspective view of a rectangular tube component 1200 of a padlock enclosure embodiment is provided. The enclosure component can be made of a variety of materials, though a strong metal that is not easily cut, broken, or drilled into is preferred. The rectangular tube component has 4 sides described in the FIG. 12 as left 1205, right 1210, top 1215, and bottom 1220, and openings described as front 1225 and back 1230. Alternative embodiments are contemplated whereby 4 sides described as front, back, top, and bottom 220, and openings described as left and right. The rectangular tube component inserted into an opening at either the left or right of the inner sleeve component as depicted in FIG. 7 or into an opening at either the front of back of the inner sleeve component as depicted in FIG. 10. The rectangular tube component is sized to fit in the empty space 1135 between the bottom of the padlock and the bottom of the enclosure. The rectangular tube can be affixed to the inside of the inner sleeve component. In the depicted embodiment, the top and bottom of the component have key slots 1235 and 1240 that are a 90 degree rotational offsets from each other, the key slots further preventing access to the keyhole of the padlock, except by the key slot. In alternative embodiments where the openings are at the top and bottom of the rectangular tube component (a vertical tube), no key slots would be possible.

Figure 13:
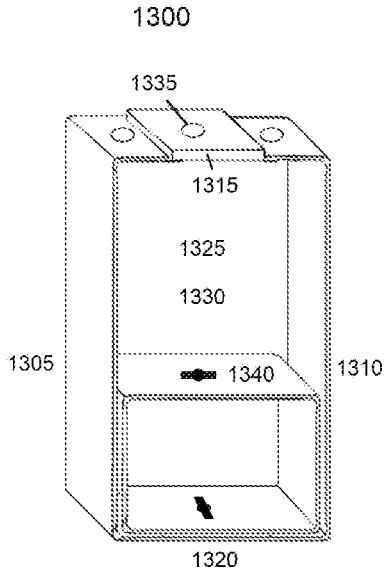
FIG. 13 is a perspective view of an alternative inner sleeve component of an enclosure embodiment.

As illustrated in FIG. 13, a perspective view of an alternative inner sleeve component 1300 of a padlock enclosure embodiment is provided. The enclosure component can be made of a variety of materials, though a strong metal that is not easily cut, broken, or drilled into is preferred. The inner sleeve component has 4 sides described as left 1305, right 1310, top 1315, and bottom 1320, and openings described as front 1325 and back 1330. The padlock is inserted into the either the front or back opening of the enclosure. The top 1315 of the sleeve has circular cutouts specifically configured to the size of the shackle legs of the padlock. Some embodiments include a circular cutout 1335 on the top 1315 capable of receiving an eyebolt or other rod that is secure in place when the padlock is latched. Both the eyebolt or rod and the top must be of sufficient thickness and strength to with significant force. The depicted embodiment includes a rectangular tube 1340, having key slots at the top and bottom, which can be affixed to the inside of the inner sleeve component. The tube is sized to fit entirely within the inner sleeve component to fit a rectangular outer tube component as depicted in FIG. 1. The padlock is inserted in to the opening at either the front or back side of the enclosure, the bottom of the lock resting on and supported by the tube 1340. A key must be inserted through the key slot at the bottom of the inner sleeve component and through the key slots on the top and bottom of the rectangular tube component to reach the keyhole of the padlock.

Figure 14:
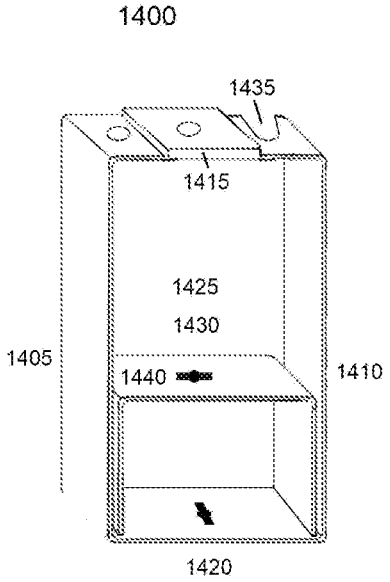
FIG. 14 is a perspective view of an alternative inner sleeve component of an enclosure embodiment.

As illustrated in FIG. 14, a perspective view of an alternative inner sleeve component 1400 of a padlock enclosure embodiment is provided. The enclosure component can be made of a variety of materials, though a strong metal that is not easily cut, broken, or drilled into is preferred. The inner sleeve component has 4 sides described as left 1405, right 1410, top 1415, and bottom 1420, and openings described as front 1425 and back 1430. The padlock is inserted into the either the front or back opening of the enclosure. The top 1415 of the sleeve has a circular cutouts specifically configured to the size of the shackle legs of the padlock and an alternative cutout 1435 that allows for a swinging shackle. Some embodiments include a circular cutout on the top 1415 capable of receiving an eyebolt or other rod that is secure in place when the padlock is latched.

Both the eyebolt or rod and the top must be of sufficient thickness and strength to with significant force. The depicted embodiment includes a U shaped plate 1440 that can be affixed to the inside of the inner sleeve component, sized to fit between the left and right sides of the inner sleeve component. The plate is sized to fit entirely within the inner sleeve component in order to fit a rectangular outer tube component as depicted in FIG. 1. The padlock is inserted into the enclosure, the bottom of the lock resting on and supported by the plate 1440. The plate has a key slot preventing access to the keyhole of the padlock, except by the key slot. The key slots can be configured to be horizontal or vertical. As depicted, the key slots is configured to be at a 90 degree rotational offset relative to the key slot at the bottom of the inner sleeve component, such that one is vertical and the other is horizontal. This offset requires a user to insert the key through the key slot, turn the key 90 degrees to insert the key into the other key slot.

Figure 15:
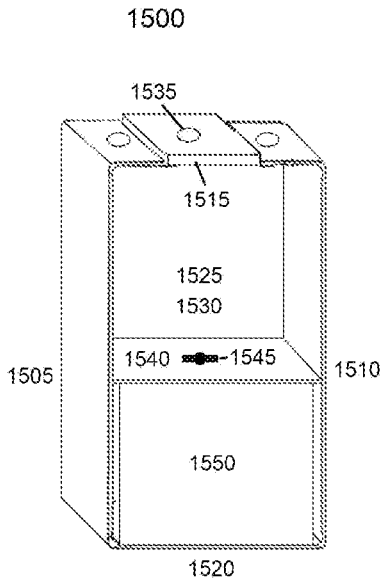
FIG. 15 is a perspective view of an alternative inner sleeve component of an enclosure embodiment.

As illustrated in FIG. 15, a perspective view of an alternative inner sleeve component 1500 of a padlock enclosure embodiment is provided. The enclosure component can be made of a variety of materials, though a strong metal that is not easily cut, broken, or drilled into is preferred. The inner sleeve component has 4 sides described as left 1505, right 1510, top 1515, and bottom 1520, and openings described as front 1525 and back 1530. The padlock is inserted into the either the front or back opening of the enclosure. The top 1515 of the sleeve has circular cutouts specifically configured to the size of the shackle legs of the padlock. Some embodiments include a circular cutout on the top 1515 capable of receiving an eyebolt or other rod that is secure in place when the padlock is latched. The depicted embodiment includes a rectangular plate 1435 affixed to the inside of the inner sleeve component, sized to fit between the left and right sides of the inner sleeve component. The plate is sized to fit entirely within the inner sleeve component to fit a rectangular outer tube component as depicted in FIG. 1. The depicted embodiment includes a vertical rectangular support tube 1545, having openings at the top and bottom, which can be affixed to the inside of the bottom of the inner sleeve component and the plate. The tube can vary in size but should fit entirely within the inner sleeve component to fit a rectangular outer tube component as depicted in FIG. 1. The padlock is inserted in to the opening at either the front or back side of the enclosure, the bottom of the lock resting the plate and supported by the tube. The plate has a key slot 1540 preventing access to the keyhole of the padlock, except by the key slot. The openings at the top and bottom of the tube are such that a key is inserted through the key slot at the bottom of the inner sleeve component and passes through the tube, through the key slot on the plate, to reach the keyhole of the padlock. The rectangular tube depicted in FIG. 13, U-shaped plate depicted in FIG. 14, and the plate and tube depicted in FIG. 15 serve as a means for supporting the padlock within the inner sleeve component, and no limitation is intended.

In other embodiments, a center rod extends from the top of the inner sleeve component to hold the ends of a chain or cable in place, such that when the padlock is secured with a shackle, the chain or cable can no longer be removed and is secured in place. This rod can be a bolt inserted from the inside of top of the sleeve component or a rod welded to the top. The center rod must be strong enough to withstand significant force and allow a chain link or large lugged end of a cable to be placed over the rod to hold the chain or cable in place. When the padlock is secured with a shackle, the chain or cable can no longer be removed and is secured in place. The top of the sleeve component must be sufficiently thick enough to withstand significant force as well.

The inner sleeve component can include a neodymium magnet or other strong magnet affixed to the enclosure bottom internally. The magnet would naturally attract to bottom side of an embodiment made from steel. This magnet is positioned next to or on top of the key slot, though the preferred embodiment is for a circular washer shaped magnet to surround the key slot opening. If a person attempts to pick the lock, the neodymium magnet will attract the picking tools and prevent picking or reduce control of the tools. Since, picking tools include bobby pins, safety pins, and paperclips, the neodymium magnet will similarly attract these tools. A key should be made out of brass or other material such as austentic stainless steel that will not be attracted to the magnet or one that is sufficiently sturdy will not be thwarted by the neodymium magnet.

Figure 16:
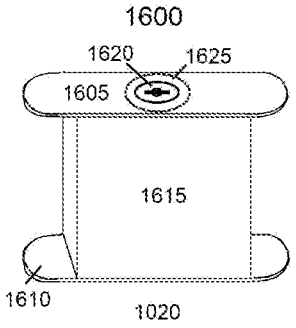
FIG. 16 is a perspective view of a plate and tube component of an enclosure embodiment.

As illustrated in FIG. 16, a perspective view of a plate and tube component 1600 sized to fit in the inner sleeve component in order to support a padlock, is provided. The depicted plate and tube component has two plates 1605, 1610 connected to a rectangular tube 1615, though other embodiments may not include the bottom plate. In some embodiments, the plates and tube are sized to fit entirely within the inner sleeve component. In the depicted embodiment, the plates are size to extend through the openings on the left and rights side of the inner sleeve component similar to one depicted in FIG. 7. The ends of the plate that extend outside of the inner sleeve component are rounded to fit an outer tube component as depicted in FIG. 5. These extensions help guide inner sleeve component as it is inserted into the outer sleeve component and help stabilize the inner sleeve component and prevent it from moving while inside the outer sleeve component. The plates have a key slot 1620 preventing access to the keyhole of the padlock, except by the key slot. The plates further include a circular washer shaped magnet 1625 to surround the key slot opening affixed to each plate.

Figure 17:
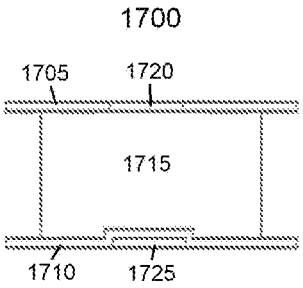
FIG. 17 is a vertical slice of the front of an alternative plate and tube component of an enclosure embodiment.

As depicted in FIG. 17, a vertical slice of the front of plate and tube component 1700 is provided. The depicted plate and tube component has two plates 1705, 1710 connected to a rectangular tube 1715. The top plate includes a circular washer shaped magnet 1720 to surround the key slot opening affixed to each plate. In the depicted embodiment, the bottom plate is shaped so that it presses a circular washer shaped magnet 1725 against the bottom of the inner sleeve component. Once inserted into the inner sleeve component, the bottom plate is supported and braced to defend against a person trying to use a hole punch or some other tool on the key slot.

Figure 18:
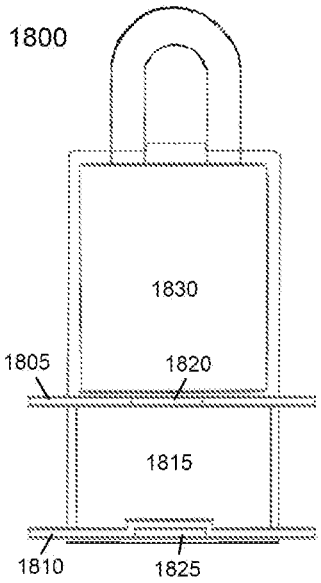
FIG. 18 is a vertical slice of the front of an inner sleeve component of an enclosure embodiment with padlock.

As depicted in FIG. 18, a vertical slice of the front of the inner sleeve component 1800 of an enclosure embodiment with padlock inserted, is provided in order to show the padlock and plate and tube component inside of the enclosure. The depicted plate and tube component has two plates 1805, 1810 connected to a rectangular tube 1815. The top plate includes a circular washer shaped magnet 1820 to surround the key slot opening affixed to each plate. In the depicted embodiment, the bottom plate is shaped so that it presses a circular washer shaped magnet 1825 against the bottom of the inner sleeve component. The padlock 1830 is inserted in to the opening at either the left or right side of the enclosure similar to one depicted in FIG. 7, the bottom of the lock resting on the plate and providing a means for supporting the padlock. The openings at the top and bottom of the tube are such that a key is inserted through the key slot at the bottom of the inner sleeve component and passes through the tube, through the key slots on the plates, to reach the keyhole of the padlock. In the depicted embodiment, the plates are size to extend through the openings on the left and rights side of the inner sleeve component. The ends of the plate that extend outside of the inner sleeve component are rounded to fit an outer tube component as depicted in FIG. 5. These extensions help guide inner sleeve component as it is inserted into the outer sleeve component and help stabilize the inner sleeve component and prevent it from moving while inside the outer sleeve component.

Figure 19:
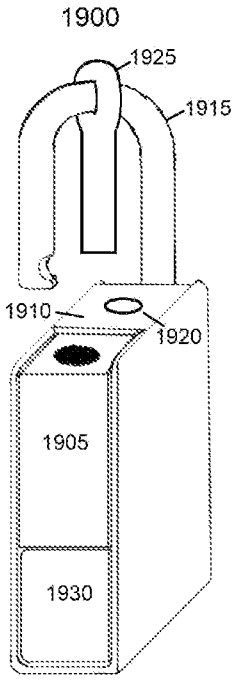
FIG. 19 is a perspective view of an alternative inner sleeve component of an enclosure embodiment with padlock.

As illustrated in FIG. 19, a perspective view of the inner sleeve component 1900 of an enclosure embodiment with padlock inserted, is provided in order to show the padlock inside of the enclosure. The padlock 1905 is inserted until it contacts the top 1910 of the inner sleeve component, the bottom of the lock resting on and supported by a rectangular tube 1930. In the depicted embodiment, a circular hole cutout 1920 allows for the insertion of the end of an eyebolt 1925 is fitted to the padlock shackle 1915. The swinging shackle 1915 can be latched, such that the top 1910 of the inner sleeve component is between the two shackle legs and the padlock 1905 cannot be removed. Once latched, the eyebolt rod is pushed downward such that the end of the eyebolt is inserted through the circular hole in the top of the inner sleeve component to hold the lugged ends of a cable or links of a chain in place. The eyebolt and top of the sleeve component are configured to be of sufficient thickness and strength to withstand significant force. A padlock with a rectangular shackle can be permanently fitted with an eyebolt that cannot be removed.

Figure 20:
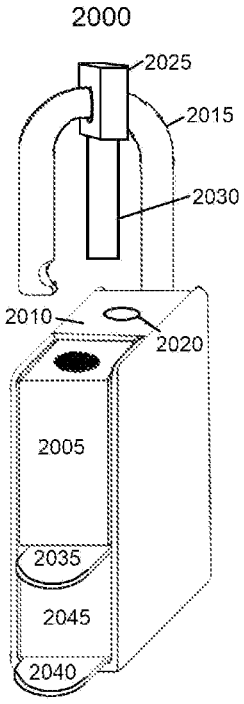
FIG. 20 is a perspective of the inner sleeve component with internal plate of an enclosure embodiment

As illustrated in FIG. 20, a perspective view of the inner sleeve component 2000 of an enclosure embodiment with padlock inserted, is provided in order to show the padlock inside of the enclosure. The padlock 2005 is inserted until it contacts the top 2010 of the inner sleeve component. In the depicted embodiment, a square nut and rod 2025, the rod inserted into the side of the nut through a drilled hole, is fitted to the padlock shackle. A circular hole cutout 2020 allows for the insertion of the end of rod. The swinging shackle 2015 can be latched, such that the top 2010 of the inner sleeve component is between the two shackle legs and the padlock 2005 cannot be removed. Once latched, the square nut rod is pushed downward such that the end of the rod is inserted through the circular hole in the top of the inner sleeve component to hold the lugged ends of a cable or links of a chain in place. A padlock with a rectangular shackle can be permanently fitted with an square nut and rod that cannot be removed. The depicted embodiment further includes plate and tube component having two plates 2035, 2040 connected to a rectangular tube 2045. The plates are size to extend through the openings of the inner sleeve component. The ends of the plate that extend outside of the inner sleeve component are rounded to fit an outer tube component as depicted in FIG. 5. These extensions help guide inner sleeve component as it is inserted into the outer sleeve component and help stabilize the inner sleeve component and prevent it from moving while inside the outer sleeve component.

Figure 21:
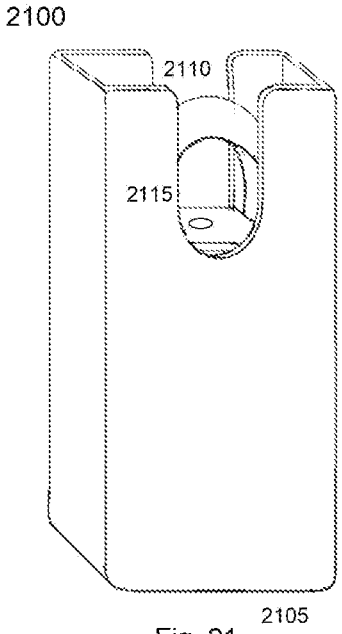
FIG. 21 is a perspective view of an enclosure embodiment with padlock.

Although the outer tube component and inner sleeve component can be used separately to improve the security of a padlock, the preferred embodiment uses the two components together to create a more effective padlock enclosure. As depicted in FIG. 21, a perspective view of an enclosure embodiment 2100 with padlock inserted, is provided in order to show the padlock inside of the enclosure. The padlock is first inserted into an opening at either the left or right of the inner sleeve component as depicted in FIG. 7 or into an opening at either the front of back of the inner sleeve component as depicted in FIG. 10. The padlock is positioned so that top of the inner sleeve component will be between the shackle legs when latched. The inner sleeve component (with padlock contained within) is then inserted into the opening at the bottom 2105 of the outer tube component. The ends of a chain or cable inserted in front and back cutouts or openings of the outer tube component are held in place by the shackles. A circular hole 2115 on the top of the inner sleeve component allows for the use of an eyebolt to hold the ends of a chain or cable in place. The left and right sides of the outer tube component encloses the left and right openings of the inner sleeve component. The bottom side of the inner sleeve component seals the bottom opening of the outer tube component. This enclosed empty space between the bottom of the lock and the bottom of the inner sleeve component can now become a space for storage of small items, such as a folded up money, a key or a key fob. The alternatives such as leaving something under a mat, or fake rock vastly less secure. The enclosure not only improves the security of the padlock and what the lock is latched to, but also adds a new secure compartment.

Figure 22:
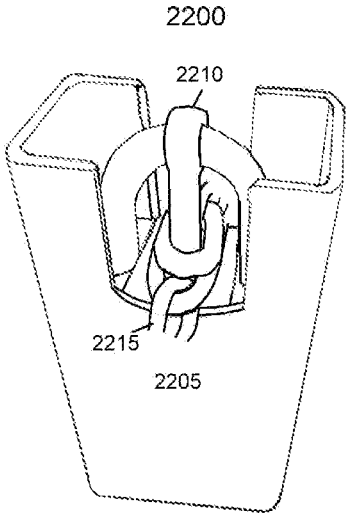
FIG. 22 is a perspective view of an enclosure embodiment with padlock.

As illustrated in FIG. 22, a perspective view of a padlock enclosure embodiment 2200 securing a chain, is provided in. A padlock inserted inside of the inner sleeve component, which is inserted inside of the outer tube component 2205. An eyebolt 2210, fitted to the padlock shackle and inserted through the circular hole in the top of the inner sleeve component such that it cannot be removed once locked, holds the ends of a chain or cable 2215 in place such that it cannot be removed when the padlock is locked. The top of the sleeve component must be sufficiently thick enough to withstand significant force as well to prevent any attempt break or bend the eyebolt.

Figure 23:
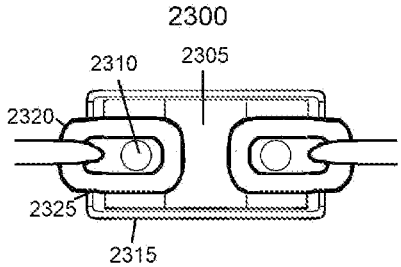
FIG. 23 is a top view of an enclosure embodiment with padlock.

As depicted in FIG. 23, a view of the top of an enclosure embodiment 2300 with padlock inserted, is provided in order to show the padlock inside of the enclosure securing two ends of a chain. The padlock is positioned such that the top of the inner sleeve component 2305 fits between the padlock shackle legs 2310. The hole in the bottom of the outer tube component 2315 should be slightly larger than the inner sleeve component 2315 to allow for the inner sleeve component to be inserted comfortably while not being able to rotate within. The ends of the chain 2325 are inserted through the openings 2320 on the left and right opposing sides of the outer tube component. The ends of the chain are positioned such that the shackle legs pass through the links. Once latched, the chain cannot be removed.

Figure 24:
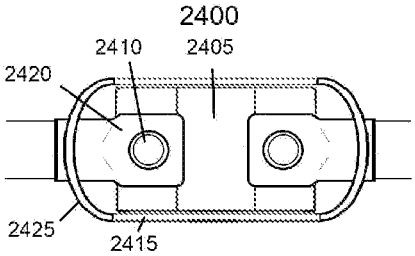
FIG. 24 is a top view of an enclosure embodiment with padlock.

As depicted in FIG. 24, a view of the top of an enclosure embodiment 2400 with padlock inserted, is provided in order to show the padlock inside of the enclosure securing two ends of a chain. The padlock is positioned such that the top of the inner sleeve component 2405 fits between the padlock shackle legs 2410. The hole in the bottom of the outer tube component 2415 should be slightly larger than the inner sleeve component 2415 to allow for the inner sleeve component to be inserted comfortably while not being able to rotate within. The lugged ends of a cable 2425 are inserted through the openings 2420 on the left and right opposing sides of the outer tube component. The ends of the cable are positioned such that the shackle legs pass through the lugged end. Once latched, the cable cannot be removed.

Figure 25:
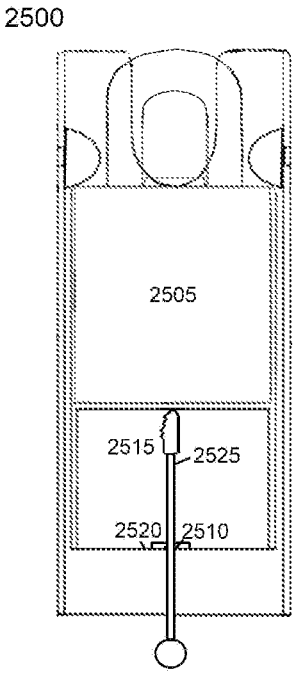
FIG. 25 is a vertical slice of the front of an enclosure embodiment with padlock.

As illustrated in FIG. 25, a vertical slice of the front of an enclosure embodiment 2500 with padlock inserted, is provided in order to show the padlock inside of the enclosure. The padlock 2505 is first inserted into an opening at either the left or right of the inner sleeve component as depicted in FIG. 7 or into an opening at either the front of back of the inner sleeve component as depicted in FIG. 10. The padlock is positioned so that top of the inner sleeve component will be between the shackle legs when latched. The inner sleeve component (with padlock contained within) is then inserted into the opening at the bottom of the outer tube component. The left and right sides of the outer tube component encloses the left and right openings of the inner sleeve component. The bottom 2520 of the inner sleeve component seals the bottom opening of the outer tube component and protects the keyhole from access except by the key slot 2510. In the depicted embodiment, the inner sleeve component is significantly taller than the lock and thus a rectangular tube 2515, which can be affixed to the bottom of the inner sleeve component supports the padlock. This distance between the bottom of the padlock and the bottom of the inner sleeve component ultimately requires a key 2525 that is long enough to pass through the key slot and continue through the tube to the keyhole of the padlock. A magnet is affixed to the bottom of the inner sleeve component.

Figure 26:
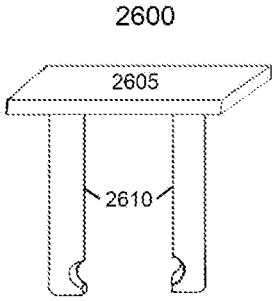
FIG. 26 is a perspective view of a top plate component.
Figure 27:
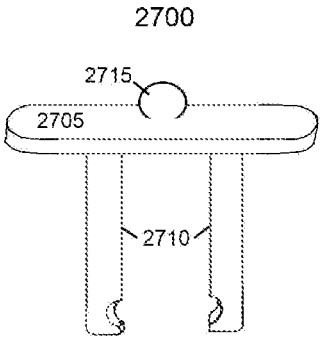
FIG. 27 is a perspective view of an alternative top plate component.

As illustrated in FIG. 26, a perspective view of a top plate component 2600, is provided. As depicted, a top plate 2605 prevents access to the lock through the opening at the top of the outer tube component. Two shackle legs 2610, extending from the bottom of the plate can be inserted into the lock body to secure the top plate in place. The shackle legs can be welded to the bottom side of the top plate, driven through the top plate or attached through other means. The top plate must be sufficiently thick to hold the attached shackle legs in place. FIG. 27 a perspective view of an alternative top plate component 2700 with a top plate 2705 and two shackle legs 2710, extending from the bottom of the plate. The top plate component can further include a knob 2715 or other means for gripping and lifting the top plate component. The top plate component is configured to be the shape and size of the opening at the top of the outer tube component. Thus the top plate component 2600 is for an outer tube component as depicted in FIG. 1, and the top plate component 2700 is for an outer tube component as depicted in FIG. 5

Figure 28:
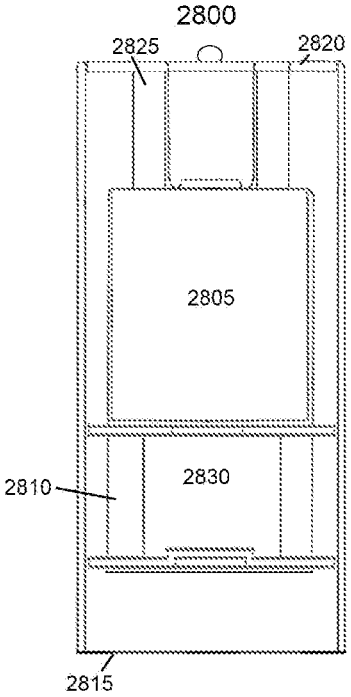
FIG. 28 is a vertical slice of the front of an enclosure embodiment with padlock.

As depicted in FIG. 28, a vertical slice of a front view of an enclosure embodiment 2800 with padlock inserted, is provided in order to show the padlock inside of the enclosure. The padlock body 2805 is first inserted into an opening at either the left or right of the inner sleeve component 2810 as depicted in FIG. 7. The inner sleeve component includes a plate and tube component 2830 having two plates connected to a rectangular tube similar to the one depicted in FIG. 17. In the depicted embodiment, the plates are sized to extend through the openings on the left and rights side of the inner sleeve component. The ends of the plates that extend outside of the inner sleeve component are rounded to fit an outer tube component as depicted in FIG. 5. The inner sleeve component (with padlock and tube and plate component contained within) is then inserted into the opening at the bottom of the outer tube component 2815. The ends of a chain or cable inserted in front and back cutouts or openings of the outer tube component are held in place by the center rod of the inner sleeve component. As depicted, a top plate component 2820, similar to the one depicted in FIG. 27, at the top of the outer tube component, prevents access to the lock body. The two shackle legs 2825 extending from the bottom of the plate are inserted into the lock body to secure the top plate in place and prevent the chain or cable from being removed. Once latched to a chain or cable, the padlock body 2805 will not be able to fall out the bottom of the enclosure. The sides of the outer tube component encloses the openings of the inner sleeve component. The bottom side of the inner sleeve component seals the bottom opening of the outer tube component. In the depicted drawing, the height of outer tube component and increased distance between the opening at the bottom outer tube component and the bottom of the inner sleeve component where the key slot is located increase the difficulty in attempting to access the key slot by lock picking tools. The enclosure can vary in how tall it is, and the drawings in no way limit the size of the enclosure contemplated by this disclosure.

Figure 29:
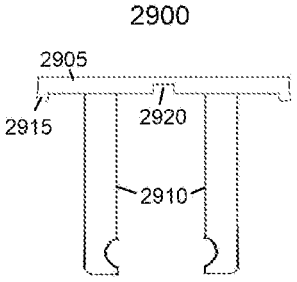
FIG. 29 is a vertical slice of the front of a top plate component.

FIG. 29 is a front view of a vertical slice of the top plate component 2900 with a top plate 2905 and two shackle legs 2910, extending from the bottom of the plate. In the depicted embodiment, the edges 2915 of the top plate extend over and around the top perimeter edge of the outer tube component. This allows for a better grip when attempting to remove the top plate in order to access the chain or cable. Other grip means include indentations, grooves and textures on the top plate component. The extended edges over the perimeter of the opening of the outer tube component also function to prevent water from rain or other sources from entering the enclosure. In the depicted embodiment, a concavity 2920 for receiving the center rod has been made in the top plate. The center rod and top plate are configured to be of sufficient thickness and strength to withstand significant force. The depression is of a depth that is sufficient to hold the rod in place and provides additional support against any force or attempt to bend the center rod. In other embodiments, a hole through the entirety of the top place, instead of a depression, holds the rod in place.

Figure 30:
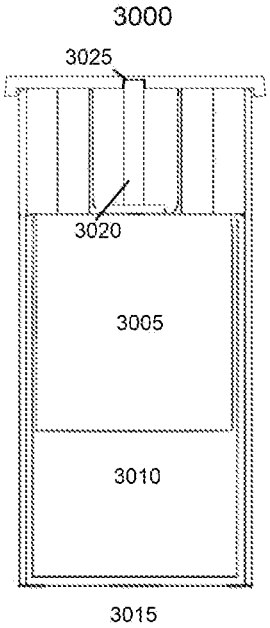
FIG. 30 is a vertical slice of the front of an enclosure embodiment with padlock.

As depicted in FIG. 30, a vertical slice of a front view of an enclosure embodiment 3000 with padlock inserted, is provided in order to show the padlock inside of the enclosure. The padlock body 3005 is first inserted into an opening at either the left or right of the inner sleeve component as depicted in FIG. 7 or into an opening at either the front of back of the inner sleeve component as depicted in FIG. 10. The inner sleeve component 3010 (with padlock contained within) is then inserted into the opening at the bottom of the outer tube component 3015. Ends of a chain or cable inserted in front and back cutouts or openings of the outer tube component are held in place by a center rod 3020 attached to the top of the inner sleeve component, as depicted in FIG. 11. Once latched, the end of the center rod is inserted through the depression 3025 in the top plate to prevent removal of the lugged ends of a cable or links of a chain. The center rod, top of the sleeve component, and top plate are configured to be of sufficient thickness and strength to withstand significant force. The left and right sides of the outer tube component encloses the left and right openings of the inner sleeve component. The bottom side of the inner sleeve component seals the bottom opening of the outer tube component.

Figure 31:
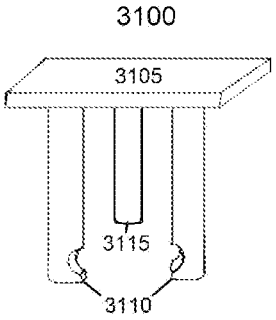
FIG. 31 is a perspective view of an alternative top plate component.

As illustrated in FIG. 31, a perspective view of a top plate component 3100, is provided. As depicted, a top plate 3105 prevents access to the lock through the opening at the top of the outer tube component. Two shackle legs 3110, extending from the bottom of the plate can be inserted into the lock body to secure the top plate in place. A center rod 3115 extends from the bottom of the plate to hold the ends of a chain or cable in place. This rod can be a machine screw inserted from the top of the plate or a rod welded to the bottom. The rod must be strong enough to withstand significant force. The plate must be sufficiently thick enough to withstand significant force as well. The center rod or shackles can be inserted through the lugged end of a cable or the end of a chain, such that when the padlock is secured, the chain or cable can no longer be removed.

Figure 32:
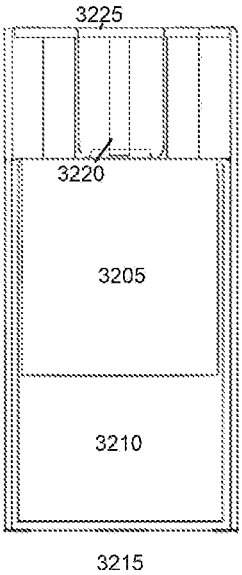
FIG. 32 is a vertical slice of the front of an alternative enclosure embodiment with padlock.

As depicted in FIG. 32, a vertical slice of a front view of an enclosure embodiment 3200 with padlock inserted, is provided in order to show the padlock inside of the enclosure. The padlock body 3205 is first inserted into an opening at either the left or right of the inner sleeve component as depicted in FIG. 7 or into an opening at either the front of back of the inner sleeve component as depicted in FIG. 10. The inner sleeve component 3210 (with padlock contained within) is then inserted into the opening at the bottom of the outer tube component 3215. As depicted, there is no center rod attached to the sleeve component. Ends of a chain or cable inserted in front and back cutouts or openings of the outer tube component are held in place by the center rod 3220 attached to the top plate component 3225. Once latched, the center rod is pushed downward such that the end of the rod is inserted through the circular hole in the top of the inner sleeve component to hold the lugged ends of a cable or links of a chain in place. The center rod, top plate, and top of the sleeve component are configured to be of sufficient thickness and strength to withstand significant force. The left and right sides of the outer tube component encloses the left and right openings of the inner sleeve component. The bottom side of the inner sleeve component seals the bottom opening of the outer tube component.

Figure 33:
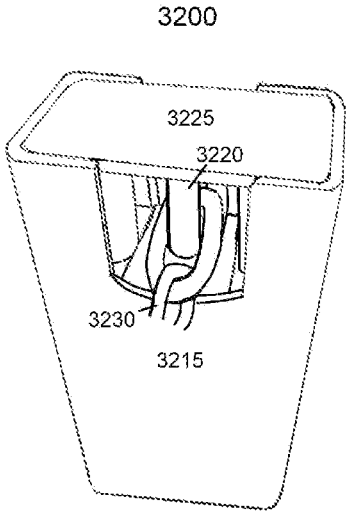
FIG. 33 is a perspective view of an alternative enclosure embodiment with padlock.

As illustrated in FIG. 33, a perspective view of a padlock enclosure embodiment 3200 securing a chain, is provided. A padlock body inserted inside of the inner sleeve component, which is inserted inside of the outer tube component 3215. The depicted embodiment includes a top plate 3225 having two shackle legs which are inserted into the lock body. A center rod 3220, attached to the top plate, holds the ends of a chain 3230 in place.

Figure 34:
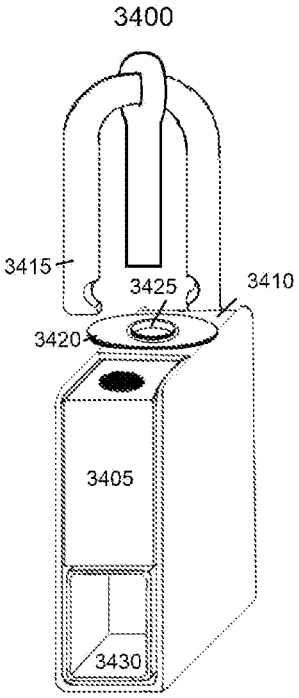
FIG. 34 is a perspective view of inner sleeve component of an enclosure with padlock

As illustrated in FIG. 34, a perspective view of the inner sleeve component 3400 of an enclosure embodiment with padlock inserted, is provided in order to show the padlock inside of the enclosure. The padlock 3405 is inserted until it contacts the top 3410 of the inner sleeve component, the bottom of the lock resting on and supported by a rectangular tube 3430. The depicted swinging shackle 3415 can be latched, such that the top 3410 of the inner sleeve component is between the two shackle legs and the padlock 3405 cannot be removed. In the depicted embodiment, a securement mechanism 3420 has been attached to top of the inner sleeve component. As depicted, the securement mechanism 3420 is an oblong piece of metal that is secured to the top of the inner sleeve component. In the present position, the securement mechanism 3420 extends over the front and back sides of the inner sleeve component. In this position, the securement mechanism 3420 prevents the inner sleeve component from falling out the bottom of the outer tube component. The securement mechanism is able to rotate so that it is entirely above the inner sleeve component and thus allowing the removal of the inner sleeve component from the outer tube component. The securement mechanism can be attached to the top of the inner sleeve component by a blind rivet nut 3425, made from steel or other strong metal in the preferred embodiment, inserted through the circular hole on the top of the inner sleeve component. A punch press or other force causes the rivet to widen holding the securement mechanism in place, while allowing it to continue to rotate. The hole in the center of the rivet continues to allow the insertion of an eyebolt fixed to a top plate to hold the end of a chain or lugged end of a cable in place. The height of the rivet is configured to be slightly less than the thickness of the securement mechanism and the top of the inner sleeve component but sufficient to hold the eyebolt in place.

Figure 35:
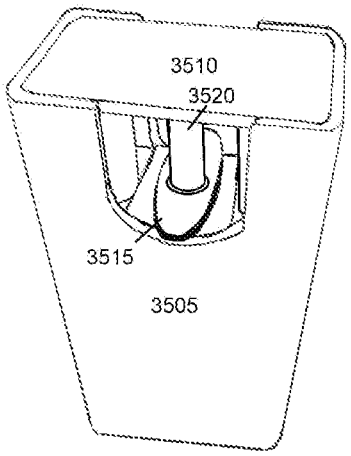
FIG. 35 is a perspective view of an enclosure embodiment with padlock.

As illustrated in FIG. 35, a perspective view of a padlock enclosure embodiment 3500 with padlock inserted, is provided in order to show the padlock inside of the enclosure. The padlock is shown inserted inside of the inner sleeve component, which is in turn inside of the outer tube component 3505. The securement mechanism 3515 has been rotated so that it extends over the front of inner sleeve component and over the front of the outer tube component. In this position, the securement mechanism 3515 prevents the inner sleeve component from falling out the bottom of the outer tube component as it is supported by the front and back sides of the outer tube component. Ends of a chain or cable inserted in front and back cutouts or openings of the outer tube component are held in place by the center rod 3520 attached to the top plate component 3510. Once latched, the center rod is pushed downward such that the end of the rod is inserted through the ends of a chain or lugged ends of a cable and through the circular hole of the blind rivet nut that is attaching the securement mechanism to the top of the inner sleeve component. The left and right sides of the outer tube component encloses the left and right openings of the inner sleeve component. The bottom side of the inner sleeve component seals the bottom opening of the outer tube component.

Figure 36:
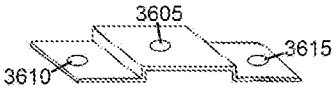
FIG. 36 is a perspective view of a bracket component.
Figure 37:
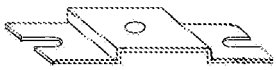
FIG. 37 is a perspective view of an alternative bracket component.
Figure 38:
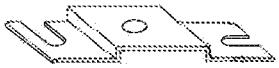
FIG. 38 is a perspective view of an alternative bracket component.
Figure 39:
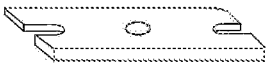
FIG. 39 is a perspective view of an alternative bracket component.

As illustrated in FIG. 36, a perspective view of a bracket component 3600, is provided. The bracket component is placed over the top of an inner sleeve component as depicted in FIG. 39, which does not have a center rod. The bracket is configured to be the size and shape of the top of the inner sleeve component and rests on top of the inner sleeve component. The bracket has 2 holes 3610, 3615 for the shackle legs to secure the lock. The outer tube component prevents the bracket from moving or rotating. The center rod attached to the top plate, holding the chain or cable in place, is inserted into the center hole 3605 of the bracket. This provides additional support for the center rod on the top plate to withstand force exerted upon it and the bracket hole depth can be configured to provide the necessary support. Such a bracket can additionally be used in combination with an eye bolt, bolt or other rod to hold chain or cable in place. As depicted in FIGS. 37 and 38, alternative embodiments 3700, 3800 can vary in the openings for the brackets to accommodate varying lock and shackle types and sizes. As depicted in FIG. 39, an alternative bracket 3900 can be made thicker and more uniform to accept the center rod. Additionally, the bracket component can be combined with an inner sleeve component in order to create an inner sleeve component augmented with the ability to better secure and support the center rod.

Figure 40:
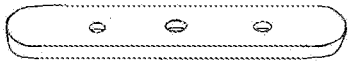
FIG. 40 is a perspective view of an alternative bracket component.
Figure 41:
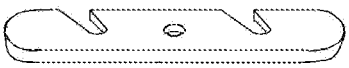
FIG. 41 is a perspective view of an alternative bracket component.

As illustrated in FIG. 40, a perspective view of an alternative bracket component 4000, is provided. The bracket is placed on top of the inner sleeve component, having 2 holes for the shackle legs and a center hole for receiving a center rod to hold a chain or cable in place. The ends of the plate that extend outside of the inner sleeve component are rounded to fit an outer tube component as depicted in FIG. 5. Once inside the outer tube component, the bracket prevents the lock and inner sleeve component from moving or rotating. As depicted in FIG. 41, an alternative embodiments 4100 is configured with cutouts for swinging shackles, and no limitation is intended with regard to the lock and shackle types and sizes that can be accommodated.

Figure 42:
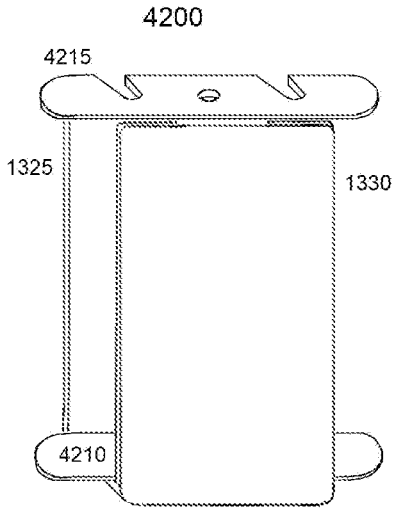
FIG. 42 is a perspective view of an inner sleeve component of an enclosure embodiment.

As illustrated in FIG. 42, a perspective view of an inner sleeve component 4200 of a padlock enclosure embodiment is provided with a bracket on top of the inner sleeve component and a plate and tube component inside of the enclosure. The enclosure components can be made of a variety of materials, though a strong metal that is not easily cut, broken, or drilled into is preferred. The inner sleeve component has 4 sides described as front, back, top, and bottom, and openings described as left and right. The padlock is inserted into the opening at either the left of right opening of the enclosure. Inside of the inner sleeve component is a plate and tube component having two plates 4205, 4210 connected to a rectangular tube. The padlock is inserted in to the opening at either the left or right side of the enclosure with the bottom of the lock resting on the plate and supported by the tube. In the depicted embodiment, the plates are sized to extend through the openings on the left and rights side of the inner sleeve component. The ends of the plate that extend outside of the inner sleeve component are rounded to fit an outer tube component as depicted in FIG. 5. These extensions help guide inner sleeve component as it is inserted into the outer sleeve component and help stabilize the inner sleeve component and prevent it from moving while inside the outer sleeve component. A bracket 4215 is placed on top of the inner sleeve component, having 2 holes for the shackle legs and a center hole for receiving a center rod to hold a chain or cable in place. The ends of the bracket that extend outside of the inner sleeve component are rounded to fit the outer tube component as depicted in FIG. 5. Once inside the outer tube component, the bracket prevents the lock and inner sleeve component from moving or rotating.

Figure 43:
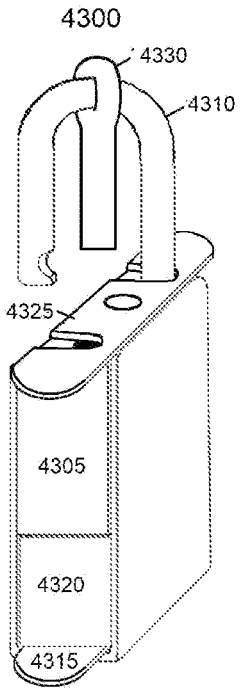
FIG. 43 is a perspective view of an alternative inner sleeve component of an enclosure embodiment with padlock.

As illustrated in FIG. 43, a perspective view of an inner sleeve component 4300 of an enclosure embodiment with padlock inserted, is provided in order to show the padlock and plate and tube component inside of the enclosure and a bracket on top of the enclosure. The padlock 4305 is inserted until it contacts the top of the inner sleeve component. The depicted embodiment further includes plate and tube component having a plate 4315 connected to a rectangular tube 4320. The plate is sized to extend through the openings of the inner sleeve component. The ends of the plate that extend outside of the inner sleeve component are rounded to fit an outer tube component as depicted in FIG. 5. These extensions help guide inner sleeve component as it is inserted into the outer sleeve component and help stabilize the inner sleeve component and prevent it from moving while inside the outer sleeve component. A bracket 4325 is placed on top of the inner sleeve component, having 2 cutouts for swinging shackle legs and a center hole for receiving a center rod or eyebolt to hold a chain or cable in place. The ends of the bracket that extend outside of the inner sleeve component are rounded to fit the outer tube component as depicted in FIG. 5. Once inside the outer tube component, the bracket prevents the lock and inner sleeve component from moving or rotating. The swinging shackle 4310 can be latched, such that the top 4310 of the inner sleeve component is between the two shackle legs and the padlock 4305 cannot be removed. Once latched, the eyebolt rod is pushed downward such that the end of the eyebolt is inserted through the circular hole in the top of the bracket to hold the lugged ends of a cable or links of a chain in place. The eyebolt and bracket component are configured to be of sufficient thickness and strength to withstand significant force.

Figure 44:
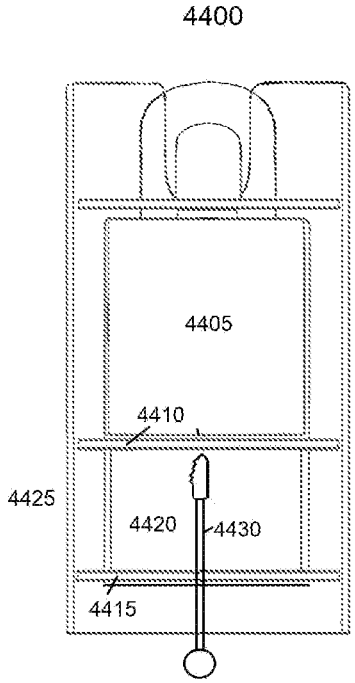
FIG. 44 is a vertical slice of the front of an enclosure embodiment with padlock.

As illustrated in FIG. 44, a vertical slice of the front of an enclosure embodiment 4400 with padlock inserted, is provided in order to show the padlock inside of the enclosure. The padlock 4405 is first inserted into an opening at either the left or right of the inner sleeve component as depicted in FIG. 7. The padlock is positioned so that top of the inner sleeve component will be between the shackle legs when latched. The depicted embodiment further includes a plate and tube component having two plates 4410, 4415 connected to a rectangular tube 4420. The plates are sized to extend through the openings of the inner sleeve component. The ends of the plate that extend outside of the inner sleeve component are rounded to fit an outer tube component as depicted in FIG. 5. These extensions help guide inner sleeve component as it is inserted into the outer sleeve component and help stabilize the inner sleeve component and prevent it from moving while inside the outer sleeve component. A bracket is placed on top of the inner sleeve component, such that the ends of the bracket that extend outside of the inner sleeve component are rounded to fit the outer tube component as depicted in FIG. 5. When the inner sleeve component is inserted into the opening at the bottom of the outer tube component 4425, the bracket prevents the lock and inner sleeve component from moving or rotating. This distance between the bottom of the padlock and the bottom of the inner sleeve component ultimately requires a key 4430 that is long enough to pass through the key slot and continue through the tube to the keyhole of the padlock.

Figure 45:
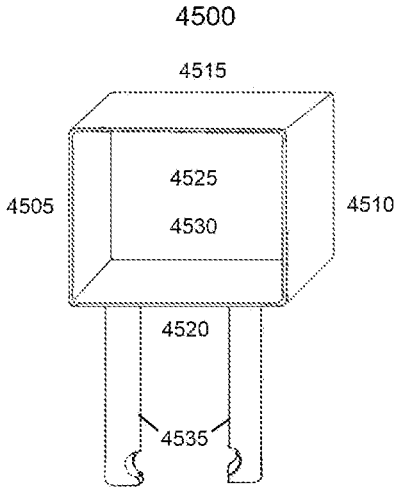
FIG. 45 is a perspective view of a storage component

As illustrated in FIG. 45, a perspective view of a rectangular storage component 4500, is provided. The a rectangular storage component has 4 sides described as left 4505, right 4510, top 4515, and bottom 4520, and openings described as front 4525 and back 4530. Alternatively, the storage component has 4 sides described as front, back, top, and bottom, and openings described as left and right. When inserted into the top of the outer tube component, the storage component prevents access to the lock through the opening at the top of the outer tube component. Further, the sides of the outer tube component encloses the openings of the inner sleeve component. This enclosed empty space of the storage component can now become a space for storage of small items, such as a folded up money, a key or a key fob. Two shackle legs 4535, extending from the bottom of the storage component can be inserted into the lock body to secure the top plate in place. The storage component, shackle legs, means for securing the legs to the bottom of the storage component must be sufficiently strong enough to withstand force. When the padlock is secured with a shackle, the chain or cable can no longer be removed and is secured in place.

Figure 46:
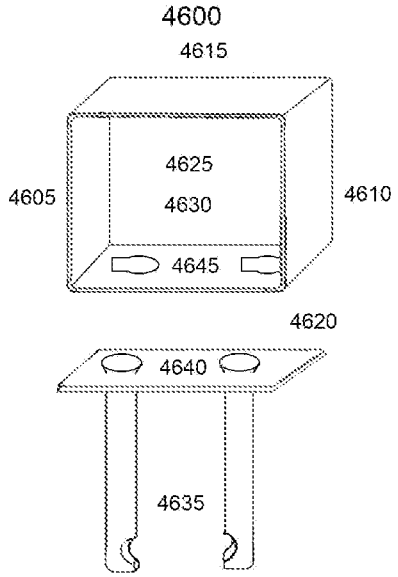
FIG. 46 is a perspective view of an alternative storage component top plate component

As illustrated in FIG. 46, a perspective view of a rectangular storage component and plate component 4600, is provided. The a rectangular storage component has 4 sides described as left 4605, right 4610, top 4615, and bottom 4620, and openings described as front 4625 and back 4630. Alternatively, the storage component has 4 sides described as front, back, top, and bottom, and openings described as left and right. A plate component, having two shackle legs 4635, extending from the bottom of the plate, has a mechanism at the top of the plate to secure it to the storage component. The circular bases 4640 of the shackle legs protruding from the top of the plate component are inserted into the openings 4645 at the bottom of the storage component. The storage component is then shifted to the right preventing the shackle leg bases from being removed from the storage component. When inserted into the top of the outer tube component, the sides of the outer tube component prevent the storage component from being shifted to the right to be detached from the plate component. Once again, this creates an enclosed empty space of the storage component.

Figure 47:
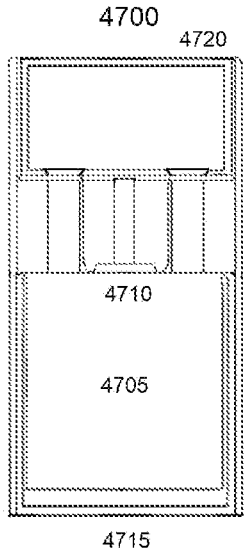
FIG. 47 is a vertical slice of the front of an enclosure embodiment with padlock.

As depicted in FIG. 47, a vertical slice of a front view of an enclosure embodiment 4700 with padlock inserted, is provided in order to show the padlock inside of the enclosure. The padlock body 4705 is first inserted into an opening at either the left or right of the inner sleeve component 4710 as depicted in FIG. 7 or into an opening at either the front of back of the inner sleeve component as depicted in FIG. 10. The inner sleeve component (with padlock contained within) is then inserted into the opening at the bottom 4715 of the outer tube component. The ends of a chain or cable inserted in front and back cutouts of the outer tube component are held in place by the center rod of the inner sleeve component. A plate component, having two shackle legs, extending from the bottom of the plate, and secured to the storage component as depicted in FIG. 36 is inserted into the opening at the top 4720 of the outer tube component. The two shackle legs extending from the bottom of the plate are inserted into the lock body to secure the lock body in place and prevent the chain or cable from being removed. When inserted into the top of the outer tube component, the sides of the outer tube this creates an enclosed empty space of the storage component. Securing the lock prevents the chain or cable from being removed.

This disclosure also contemplates using some of the features discussed herein to make improvements to padlocks. An outer tube component could be affixed, through welding or other means, to the bottom of a padlock. The tube at increased lengths increases the difficulty of picking the padlock. This length ultimately requires a key, made longer by extending the handle, or requires a tool, such as a wand or forceps that is able to grasp the key to access the keyhole of the padlock. While an owner of the enclosure and padlock would invariably carry, have access to, or have knowledge of the whereabouts of such a key (an owner knows when they intend to open a lock), it would be less likely that a lock picker would carry tools of the necessary length.

Figure 48:
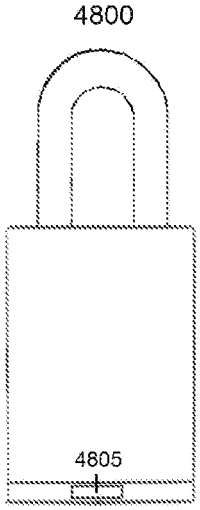
FIG. 48 is a front view of a padlock having a magnet.

As depicted in FIG. 48, a neodymium magnet can be added to the bottom of a padlock 4800 to prevent access to the keyhole by picking tools that the neodymium magnet 4805 will attract, thus preventing access to the keyhole except using the key. This can be done by adding a plate that can be affixed, through welding or other means, to the bottom of the padlock. Similar to as described in FIGS. 19 and 20, such a plate could have a circular cutout or a key slot allowing access to the keyhole and could house a neodymium magnet of varying shapes though a washer is preferred. Such a plate containing a neodymium magnet washer would not add a significant amount of length to a padlock. Alternatively, the padlock housing can be made longer in order to house a neodymium magnet, of varying shapes though a washer is preferred. If necessary, a material able to absorb the magnetism of the neodymium magnet, to prevent the magnet from affecting the pins of the padlock, can be configured between the magnet and the locking mechanism. Adding a key slot to the base of the padlock would require a key configured to access the keyhole through the key slot.

The preceding description contains embodiments of the invention and no limitation of the scope is thereby intended. It will be further apparent to those skilled in the art that various modifications and variations can be made in the present invention without departing from the spirit or scope of the invention.

The invention claimed is:

1. A sleeve enclosure for protecting a padlock, the padlock having a body, a shackle, and a keyhole, said enclosure comprising:

four walls: top, bottom, front and back;

openings at the left and right for receiving the padlock;

openings at the top to access padlock shackle holes;

a key slot on the bottom of the enclosure and below the keyhole, the key slot limiting access to the keyhole except by a key;

the height of the enclosure such that the distance between the top and bottom of the enclosure is greater than the height of the padlock body;

a support plate supporting the padlock above the bottom of the enclosure resulting in an internal empty space between the support plate and the bottom of the enclosure;

a key slot on the support plate and below the keyhole, the key slot limiting access to the keyhole except by a key.

2. The sleeve enclosure of claim 1 further comprising:

a magnet internally affixed in place to the bottom of the enclosure adjacent to the key slot on the bottom of the enclosure that is capable of adhering to metallic objects inserted through the key slot.

3. The sleeve enclosure of claim 1, wherein the magnet is internally held in place on the bottom of the enclosure by an internal plate.

4. The sleeve enclosure of claim 1, wherein the key slot on the bottom of the enclosure is configured to be at a 90 degree rotation relative to the keyhole on the padlock.

5. The sleeve enclosure of claim 1, wherein the support plate further includes a magnet internally affixed and adjacent to the key slot on the support plate that is capable of adhering to metallic objects inserted through the key slot.

6. An enclosure for protecting a padlock, the padlock having a body, a shackle and a keyhole, said enclosure comprising:

a sleeve component having:

four walls: top, bottom, front and back;

openings at the left and right for receiving the padlock;

cutouts at the top to access padlock shackle holes;

a key slot on the bottom of the sleeve component and limiting, access to the keyhole except by a key;

the height of the enclosure such that, the distance between the top and bottom of the enclosure is greater than the height of the padlock body resulting in an internal empty space between a bottom of the padlock and the bottom of the enclosure;

a means for supporting the padlock above the internal empty space adding additional security by requiring a key to pass through the empty space to reach the keyhole;

wherein the sleeve component containing the padlock is inserted into a tubular component;

the tubular component having:

walls forming the tubular component an opening at the bottom for receiving the padlock;

an opening at the top for accessing the shackle;

two directly opposing openings on the walls of the tubular component, the height of the tubular component such that the tubular component fully contains the sleeve component.

7. The enclosure of claim 6, wherein the means for supporting the padlock extends out the openings of the sleeve components to the walls of the tubular component.

8. The enclosure of claim 6 further comprising:

the sleeve component having:

a securement mechanism on the top of the sleeve component to prevent the padlock from falling through the opening at the bottom of the tubular component.

9. The enclosure of claim 6, wherein the containing of the sleeve component within the tubular component creates a storage compartment within the enclosure below the padlock.

10. The enclosure of claim 6 further comprising:
the sleeve component having:
a magnet internally affixed in place to the bottom of the enclosure adjacent to the key slot on the bottom of the sleeve component that is capable of adhering to metallic objects inserted through the key slot.

11. The enclosure of claim 6 further comprising:
a plate component having:
a top plate of shape and size of the opening at the top of the tubular component;
shackle legs extending from the bottom of the top plate inserted into the padlock body instead of the padlock shackle.

12. The enclosure of claim 11 further comprising:
the sleeve component having:
a rod extending from the center of the top of the sleeve component;
the plate component having:
a concavity for receiving the rod extending from the center of the top of the sleeve component.

13. The enclosure of claim 11 further comprising:
the sleeve component having:
a hole in the center of the top of the sleeve component;
the plate component having:
a rod extending from the bottom of the top plate to be inserted into the hole in the center of the top of the sleeve component.

14. The enclosure of claim 11 further comprising:
a bracket having:
a plate of shape and size of the top of the sleeve component on top of the sleeve component;
a hole in the center of the bracket;
the plate component having:
a rod extending from the bottom of the top plate to be inserted into the hole in the center of the bracket.

15. The enclosure of claim 6 further comprising:
the sleeve component having:
a hole in the center of the top of the sleeve component;
an eyebolt fitted to the padlock shackle to be inserted into the hole in the center of the top of the sleeve component.

16. The enclosure of claim 6 further comprising:
a bracket having:
a plate of shape and size of the top of the sleeve component on top of the sleeve component.

17. The enclosure of claim 6 further comprising:
a storage component having:
four walls: top, bottom, left and right;
openings at the front and back;
shackle legs extending from the bottom of the storage component inserted into the padlock body instead of the padlock shackle;
wherein the storage component inserted the top of the tubular component and fully enclosed by the tubular component.

18. The enclosure of claim 11 further comprising:
a storage component having:
four walls: top, bottom, left and right;
openings at the front and back;
wherein the bottom of the storage component is secured to the top of the plate component and the storage component inserted the top of the tubular component and fully enclosed by the tubular component.

19. An enclosure for protecting a padlock, the padlock having a body, a shackle and a keyhole, said enclosure comprising:
a sleeve component having:
four walls: top, bottom, front and back;
openings at the left and right for receiving the padlock;
cutouts at the top to access padlock shackle holes;
a key slot on the bottom of the sleeve component and limiting access to the keyhole except by a key;
the height of the enclosure such that the distance between the top and bottom of the enclosure is greater than the height of the padlock body;
a support plate supporting the padlock above the bottom of the enclosure resulting in an internal empty space between the support plate and the bottom of the enclosure;
a key slot on the support plate and below the keyhole, the key slot limiting access to the keyhole except by a key;
wherein the sleeve component containing the padlock is inserted into a tubular component;
the tubular component having:
walls forming the tubular component
an opening at the bottom for receiving the padlock;
an opening at the top for accessing the shackle;
two directly opposing openings on the walls of the tubular component;
the height of the tubular component such that the tubular component fully contains the sleeve component.

20. The enclosure of claim 19 further comprising:
the sleeve component having:
a magnet internally affixed in place to the bottom of the enclosure adjacent to the key slot on the bottom of the sleeve component that is capable of adhering to metallic objects inserted through the key slot.

* * * * *